US008259146B2

(12) United States Patent
Fukamachi et al.

(10) Patent No.: US 8,259,146 B2
(45) Date of Patent: Sep. 4, 2012

(54) IMAGE FORMING APPARATUS, CONTROL METHOD THEREFOR, AND PROGRAM

(75) Inventors: Hitoshi Fukamachi, Kawasaki (JP); Yoshihito Machida, Yokohama (JP); Hideki Kubo, Kawasaki (JP); Atsushi Ushiroda, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 658 days.

(21) Appl. No.: 12/352,205

(22) Filed: Jan. 12, 2009

(65) Prior Publication Data

US 2009/0185024 A1 Jul. 23, 2009

(30) Foreign Application Priority Data

Jan. 23, 2008 (JP) ..... 2008-013087

(51) Int. Cl.

| | |
|---|---|
| ***B41J 2/435*** | (2006.01) |
| ***B41J 2/455*** | (2006.01) |
| ***B41J 2/47*** | (2006.01) |
| ***B41J 27/00*** | (2006.01) |

(52) U.S. Cl. ..... 347/236; 347/233; 347/253; 347/241

(58) Field of Classification Search ..... 347/241, 347/233, 236, 253

See application file for complete search history.

(56) References Cited

U.S. PATENT DOCUMENTS

| | | | | |
|---|---|---|---|---|
| 5,751,748 | A | 5/1998 | Uejima et al. | |
| 6,700,595 | B2 * | 3/2004 | Sugyiama et al. | 347/133 |
| 2001/0005214 | A1 * | 6/2001 | Nakagawa et al. | 347/133 |

FOREIGN PATENT DOCUMENTS

| | | | |
|---|---|---|---|
| JP | 05-294005 | | 11/1993 |
| JP | 08-330661 | | 12/1996 |
| JP | 09197776 | A * | 7/1997 |
| JP | 2003-255652 | A | 9/2003 |
| JP | 2003255652 | A * | 9/2003 |
| JP | 2004-276582 | A | 10/2004 |

OTHER PUBLICATIONS

The above reference was cited in a Sep. 10, 2010 Chinese Office Action, that issued in Chinese Patent Application No. 200910001183.8.

The above reference was cited in a Feb. 28, 2011 Chinese Office Action, that issued in Chinese Patent Application No. 200910001183.8.

* cited by examiner

*Primary Examiner* — Stephen Meier
*Assistant Examiner* — Sarah Al Hashimi
(74) *Attorney, Agent, or Firm* — Cowan, Liebowitz & Latman, P.C.

(57) ABSTRACT

The image densities of images formed with a plurality of laser beams on the basis of image data are measured. The quantity of each of the plurality of laser beams is adjusted in accordance with the measurement result.

6 Claims, 8 Drawing Sheets

IMAGE FORMING APPARATUS, CONTROL METHOD THEREFOR, AND PROGRAM

BACKGROUND OF THE INVENTION

1. Field of the Invention

The present invention relates to an image forming apparatus which has a light source for emitting a plurality of laser beams, forms a latent image on an image carrier with a plurality of laser beams emitted from the light source, and forms, onto a printing medium, an image developed on the image carrier, a control method therefor, and a program.

2. Description of the Related Art

Generally, a conventional electrophotographic image forming apparatus forms an image or electrostatic latent image corresponding to an image signal with a laser beam on a photoconductive drum or photoconductive belt. The image forming apparatus develops the latent image, and transfers the developed image onto a sheet, forming an image.

The electrophotographic image forming apparatus needs to scan the photoconductor simultaneously with a plurality of beams in order to increase the speed and resolution.

It is difficult to integrate edge-emitting semiconductor lasers (LDs: Laser Diodes) generally employed as the light source of an image forming apparatus. The number of beams capable of simultaneous scanning and exposure is small (e.g., four). For this reason, it is becoming popular to use, as the light source of an image forming apparatus, a VCSEL (Vertical Cavity Surface Emitting diode Laser) in which a plurality of light emitting points are two-dimensionally arrayed (see Japanese Patent Laid-Open No. 5-294005). The VCSEL can be easily arrayed. By using the VCSEL as the light source, the image forming apparatus can simultaneously scan and expose the photoconductor with a larger number of beams (multi-beam array).

However, when the image forming apparatus uses a multi-beam array such as the VCSEL, the density becomes nonuniform, and a horizontal streak appears in an output image owing to nonuniform exposure on the photoconductive drum or photoconductive belt.

To form a high-quality image, it is important to control the beam quantity. Generally in an image forming apparatus using a light source (multi-beam light source) for emitting a plurality of beams, the quantity of each beam is measured in a predetermined cycle to control the quantity of each emitted beam such that a measured beam quantity coincides with a predetermined one.

The edge-emitting LD conventionally used as a light source emits a main beam forward for image formation, and a back beam backward at a predetermined ratio to the main beam quantity. The main beam quantity can be controlled based on the back beam quantity by incorporating a PD (Photo Diode) in the package of the edge-emitting LD, and measuring (monitoring) the back beam quantity by the PD.

Since the VCSEL does not emit a back beam, a PD for monitoring the beam quantity needs to be arranged outside the package of the VCSEL. Generally in the image forming apparatus, a half-mirror is inserted in the optical path of a beam emitted from the VCSEL. The half-mirror splits a beam emitted from the VCSEL into a beam (main beam) for forming an image and a monitor beam for measuring the beam quantity. The PD measures the quantity of the split monitor beam, and the main beam quantity is controlled based on the monitor beam quantity (see Japanese Patent Laid-Open No. 8-330661).

It is generally known that an optical member such as a half-mirror changes the reflectance and transmittance in accordance with the deflection direction of an incoming light beam. As for the VCSEL, unlike the edge-emitting LD, the deflection direction with respect to the optical axis is not always constant owing to the structure of the VCSEL. Thus, if a plurality of beams emitted from the VCSEL array is split by the half-mirror, the ratio of a transmitted beam and reflected beam differs between beams owing to variations of the deflection direction. As a result, the ratio of the split main beam and monitor beam changes.

If an image is formed while the main beam quantity differs between beams, the exposure distribution on the photoconductor becomes irregular, resulting in poor image quality such as nonuniform density.

As described above, when the multi-beam array is employed, each laser intensity changes owing to variations in the optical member and developing process. A formed image suffers poor image quality such as nonuniform density.

SUMMARY OF THE INVENTION

The present invention has been made to overcome the conventional drawbacks, and has as its object to provide an image forming apparatus capable of preventing degradation of the image quality such as density nonuniformity in a formed image, a control method therefor, and a program.

According to the first aspect of the present invention, an image forming apparatus which has a light source for emitting a plurality of laser beams, forms a latent image on an image carrier with a plurality of laser beams emitted from the light source, and forms, onto a printing medium, an image developed on the image carrier, the apparatus comprises: measurement unit adapted to measure image densities of images formed with the plurality of laser beams on the basis of image data; and adjusting unit adapted to adjust a quantity of each of the plurality of laser beams in accordance with a measurement result of the measurement unit.

In a preferred embodiment, the measurement unit measures, as the image density, a density of an output image formed on the image carrier or the printing medium on the basis of the image data.

In a preferred embodiment, the measurement unit measures, as the image density, a potential value corresponding to a latent image formed on the image carrier on the basis of the image data.

In a preferred embodiment, the adjusting unit adjusts the quantity of each of the plurality of laser beams so as to match a density of an output image formed on the printing medium with a target density characteristic in accordance with the measurement result of the measurement unit.

In a preferred embodiment, by using image densities of images formed with respective laser beams that are measured by the measurement unit, the adjusting unit adjusts quantities of the corresponding laser beams.

In a preferred embodiment, the measurement unit measures image densities of images formed with respective combinations of a laser beam to be adjusted, and laser beams used in combination with the laser beam to be adjusted, and the adjusting unit adjusts a quantity of the laser beam to be adjusted on the basis of an average of the image densities of the images formed by the respective combinations of the laser beam to be adjusted, and the laser beams used in combination that are measured by the measurement unit.

According to the second aspect of the present invention, a method of controlling an image forming apparatus which has a light source for emitting a plurality of laser beams, forms a latent image on an image carrier with a plurality of laser beams emitted from the light source, and forms, onto a printing medium, an image developed on the image carrier, the method comprises: a measurement step of measuring image densities of images formed with the plurality of laser beams on the basis of image data; and an adjusting step of adjusting a quantity of each of the plurality of laser beams in accordance with a measurement result of the measurement step.

According to the third aspect of the present invention, a program stored in a computer-readable medium to cause a computer to control an image forming apparatus which has a light source for emitting a plurality of laser beams, forms a latent image on an image carrier with a plurality of laser beams emitted from the light source, and forms, onto a printing medium, an image developed on the image carrier, the program causes the computer to execute a measurement step of measuring image densities of images formed with the plurality of laser beams on the basis of image data, and an adjusting step of adjusting a quantity of each of the plurality of laser beams in accordance with a measurement result of the measurement step.

Further features of the present invention will be apparent from the following description of exemplary embodiments with reference to the attached drawings.

DESCRIPTION OF THE EMBODIMENTS

Preferred embodiments of the present invention will now be described in detail with reference to the drawings. It should be noted that the relative arrangement of the components, the numerical expressions and numerical values set forth in these embodiments do not limit the scope of the present invention unless it is specifically stated otherwise.

First Embodiment

Figure 1:
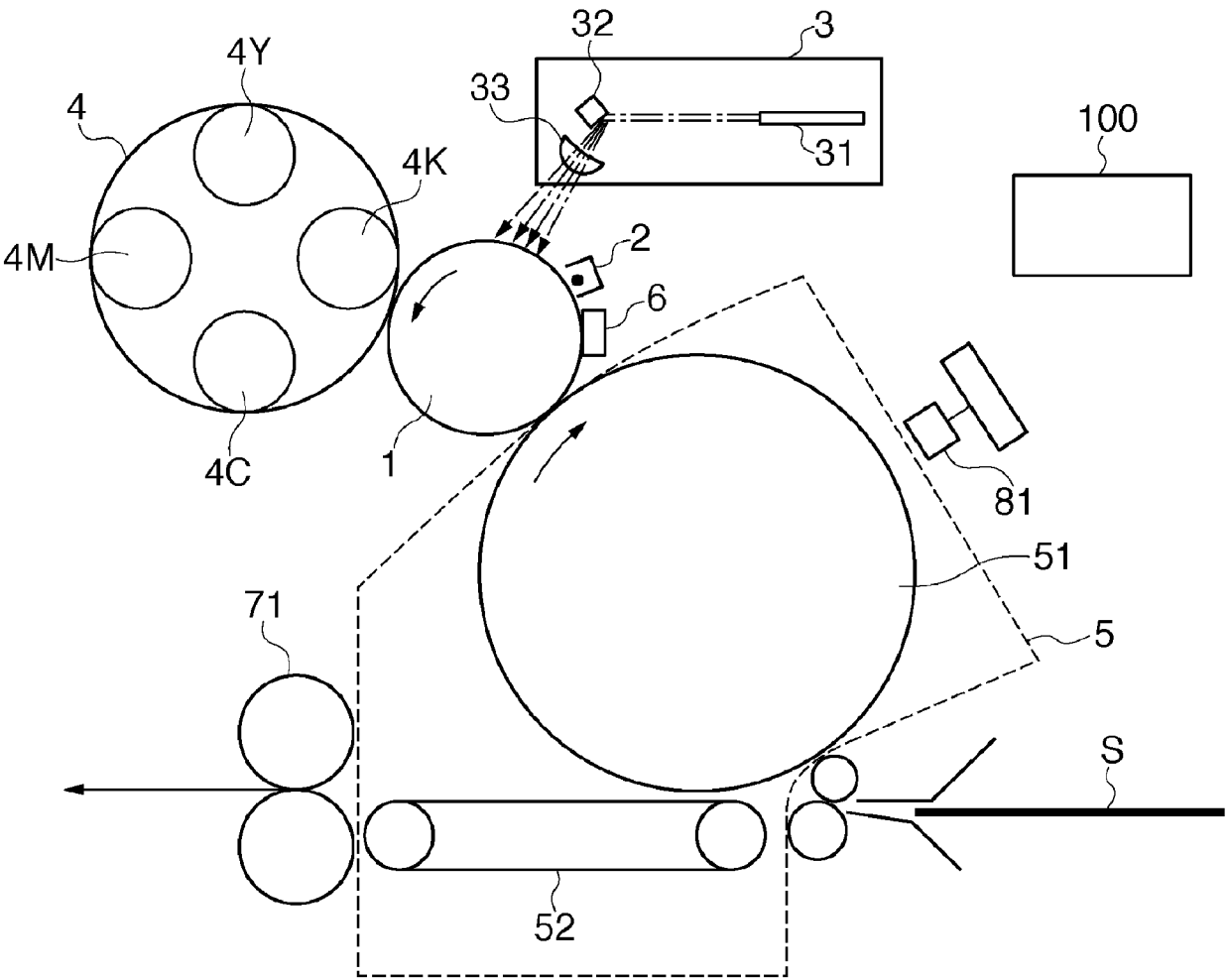
FIG. 1 is a sectional view showing the schematic structure of an image forming apparatus according to the first embodiment of the present invention.

FIG. 1 is a sectional view showing the schematic structure of an image forming apparatus according to the first embodiment of the present invention.

The image forming apparatus includes a photoconductive drum 1 serving as an image carrier, a charging unit 2 for forming an electrostatic latent image, an exposure unit 3, and a developing unit 4 for developing an electrostatic latent image into a visible image. The image forming apparatus also includes a transfer unit 5 for transferring an image developed by the developing unit 4 onto a transfer material S serving as a printing medium, and a fixing unit 71 for fixing an image by the heat and pressure onto the transfer material S having undergone transfer processing.

The photoconductive drum 1 is formed from a photoconductive layer of an OPC (Organic Photo Conductor) or the like on the outer surface of a metal drum base. The photoconductive drum 1 is driven to rotate by a driving unit (not shown). The photoconductive drum 1 is surrounded with the charging unit 2, the exposure unit 3, the developing unit 4, the transfer unit 5, a cleaning unit 6, and the like.

The charging unit 2 includes a charging roller (not shown) arranged in contact with the surface of the photoconductive drum 1, and a charging bias wire for applying a charging bias to the charging roller. The charging unit 2 uniformly charges the surface of the photoconductive drum 1.

The exposure unit 3 includes a laser oscillator 31, polygon mirror 32, Fθ lens 33, and the like. The exposure unit 3 irradiates the surface of the photoconductive drum 1 with a plurality of laser beams (multiple beams) emitted from the laser oscillator 31 on the basis of input image data, forming an electrostatic latent image on the surface of the photoconductive drum 1.

The first embodiment will exemplify the exposure unit 3 formed from a multi-beam array (VCSEL) capable of simultaneously scanning and exposing the photoconductive drum with four beams. In other words, the exposure unit 3 is a light source for emitting a plurality of laser beams which can be independently modulated.

The developing unit 4 includes a developing vessel which stores developers (toners) of four colors, that is, yellow (Y) 4Y, magenta (M) 4M, cyan (C) 4C, and black (K) 4K. The developing unit 4 applies the respective toners to an electrostatic latent image on the photoconductive drum 1, developing the image as a toner image.

The transfer unit 5 includes an intermediate transfer drum 51 serving as an image carrier formed cylindrically. The transfer unit 5 primarily transfers, onto the intermediate transfer drum 51, a toner image on the photoconductive drum 1.

The cleaning unit 6 includes a cleaning blade arranged in contact with the surface of the photoconductive drum 1. The cleaning unit 6 removes toner which is not primarily transferred onto the intermediate transfer drum and remains on the photoconductive drum 1 after primary transfer.

A secondary transfer belt 52 is arranged below the intermediate transfer drum 51. Toner images of the four colors primarily transferred on the intermediate transfer drum 51 are secondarily transferred at once onto the transfer material S. The fixing unit 71 fixes, by heat and pressure, the toner image secondarily transferred on the transfer material S.

A density sensor 81 is arranged near the intermediate transfer drum 51 to face the surface of the intermediate transfer drum 51. When the image forming apparatus performs image density control, the density sensor 81 can measure the density of an image formed on the intermediate transfer drum 51.

A controller 100 formed from a CPU, RAM, ROM, and the like controls various building components of the image forming apparatus. The ROM in the controller 100 stores a program for executing various processes according to the present invention. The CPU executes various processes on the basis of the program.

Figure 2:
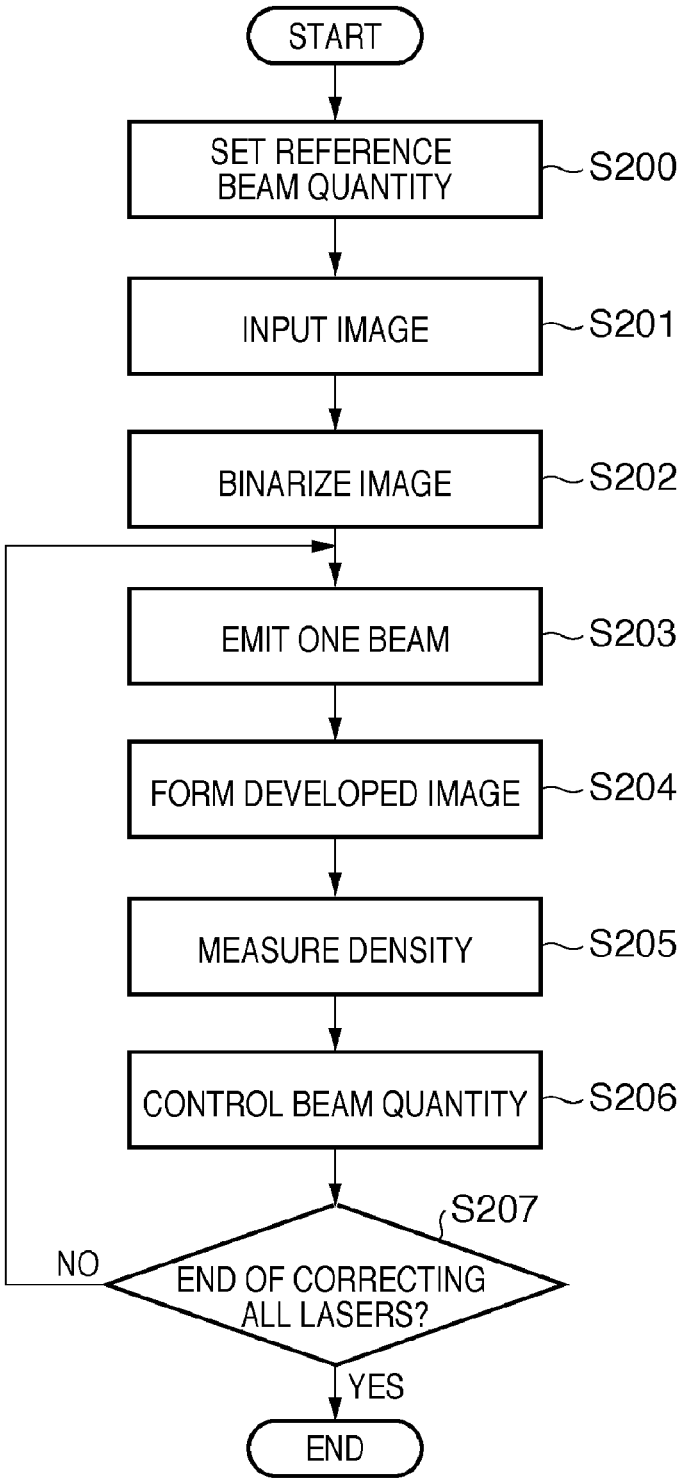
FIG. 2 is a flowchart showing the sequence of processing for controlling the quantities of multiple beams emitted from a laser oscillator according to the first embodiment of the present invention.

FIG. 2 is a flowchart showing the sequence of processing for controlling the quantities of multiple beams emitted from the laser oscillator according to the first embodiment of the present invention.

This processing is implemented under the control of the controller 100.

A given reference laser intensity is set for each of four laser beams for scanning and exposure by the exposure unit 3 (step S200).

Figure 3:
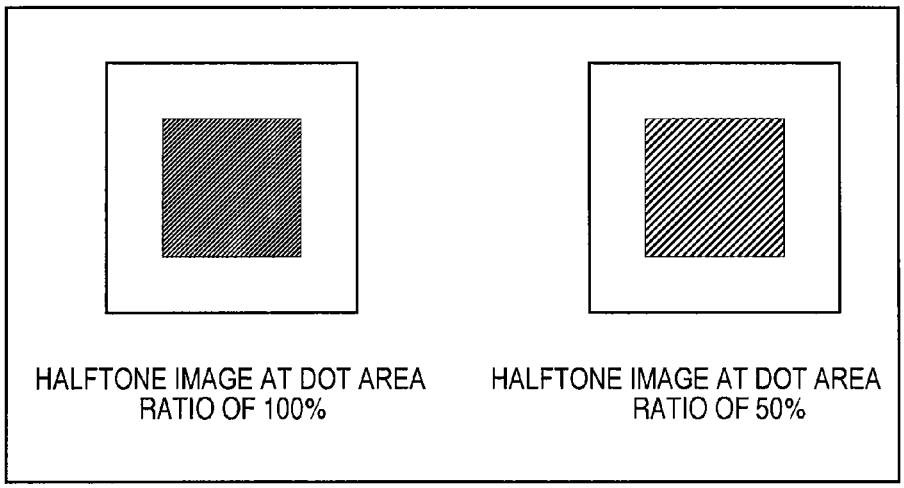
FIG. 3 is a view showing an example of input image data according to the first embodiment of the present invention.

Then, predetermined image data is input (step S201). The predetermined input image data is a patch image as shown in FIG. 3. The patch image may also be a solid image at a dot area ratio of 100% or a halftone image at a dot area ratio of, for example, 50%.

The image data input in step S201 is binarized (step S202). As the binarization method, it suffices to select a binarization method corresponding to one of printing modes.

The exposure unit 3 irradiates the surface of the photoconductive drum 1 with laser beams, forming an electrostatic latent image (step S203). In the first embodiment, the laser beams are emitted one by one to form an image.

Figure 4:
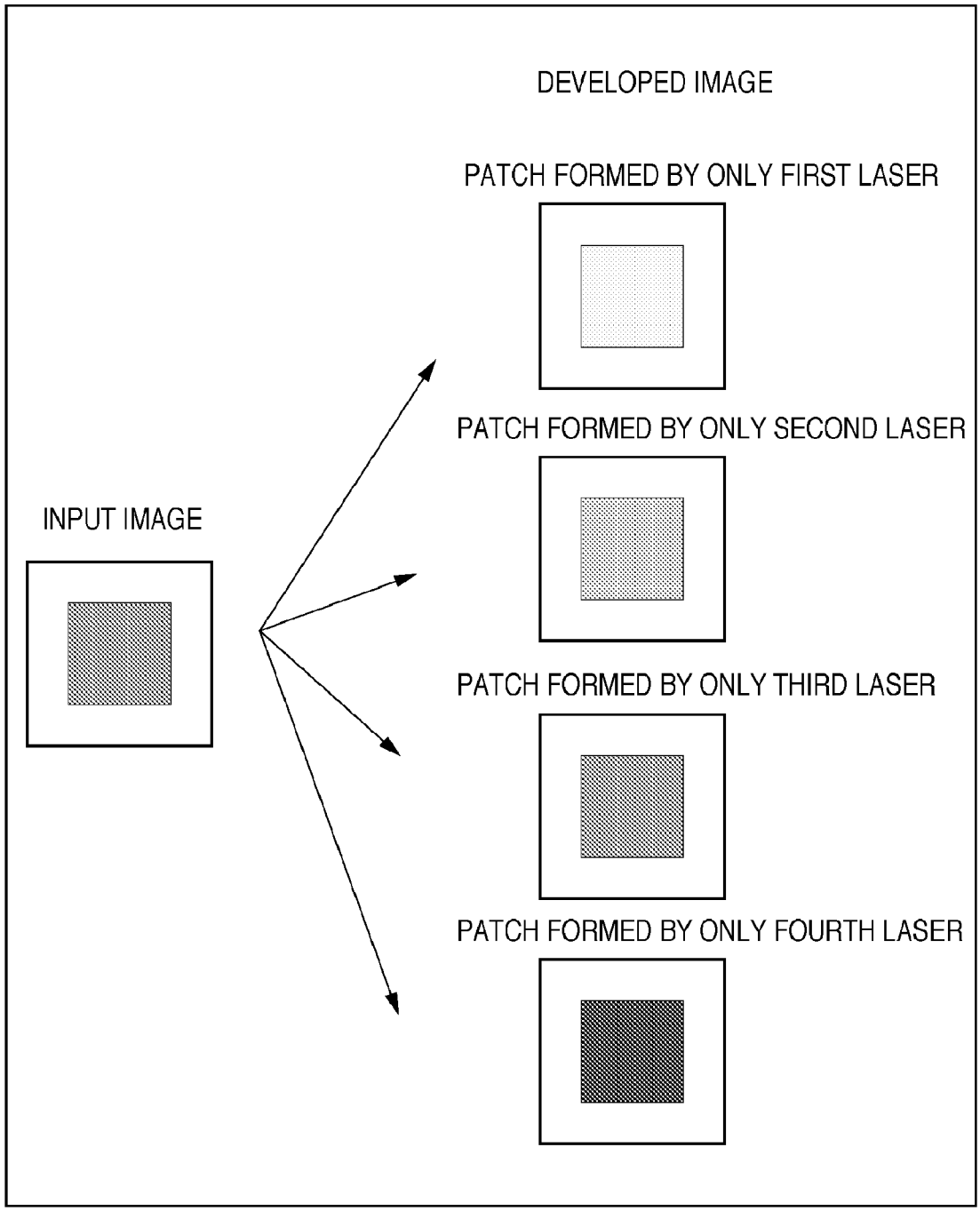
FIG. 4 is a view showing an example of a developed image according to the first embodiment of the present invention.

The developing unit 4 applies toner to the electrostatic latent image formed on the photoconductive drum 1, developing the image as a toner image (step S204). FIG. 4 shows an image formed on the photoconductive drum 1 by only one laser. The density after developing varies depending on the difference in laser intensity.

The toner image on the photoconductive drum 1 is primarily transferred onto the intermediate transfer drum 51. The density sensor 81 measures the density of a patch image which is the primarily transferred toner image (step S205).

The laser intensity is adjusted to make the density value of the patch image measured by the density sensor 81 coincide with a predetermined density value (target density value) (step S206), controlling the beam quantity of a target laser. For example, the quantity of a laser beam emitted from the exposure unit 3 is controlled (modulated) to match the density of an output image printed on a printing medium with a target density characteristic (or density value).

After that, the laser to be turned on is switched among all lasers in the multi-beam array of the exposure unit 3, and the processes in steps S203 to S206 are repeated (step S207). After the processes in steps S203 to S206 are done for all the lasers, the process ends.

Figure 5:
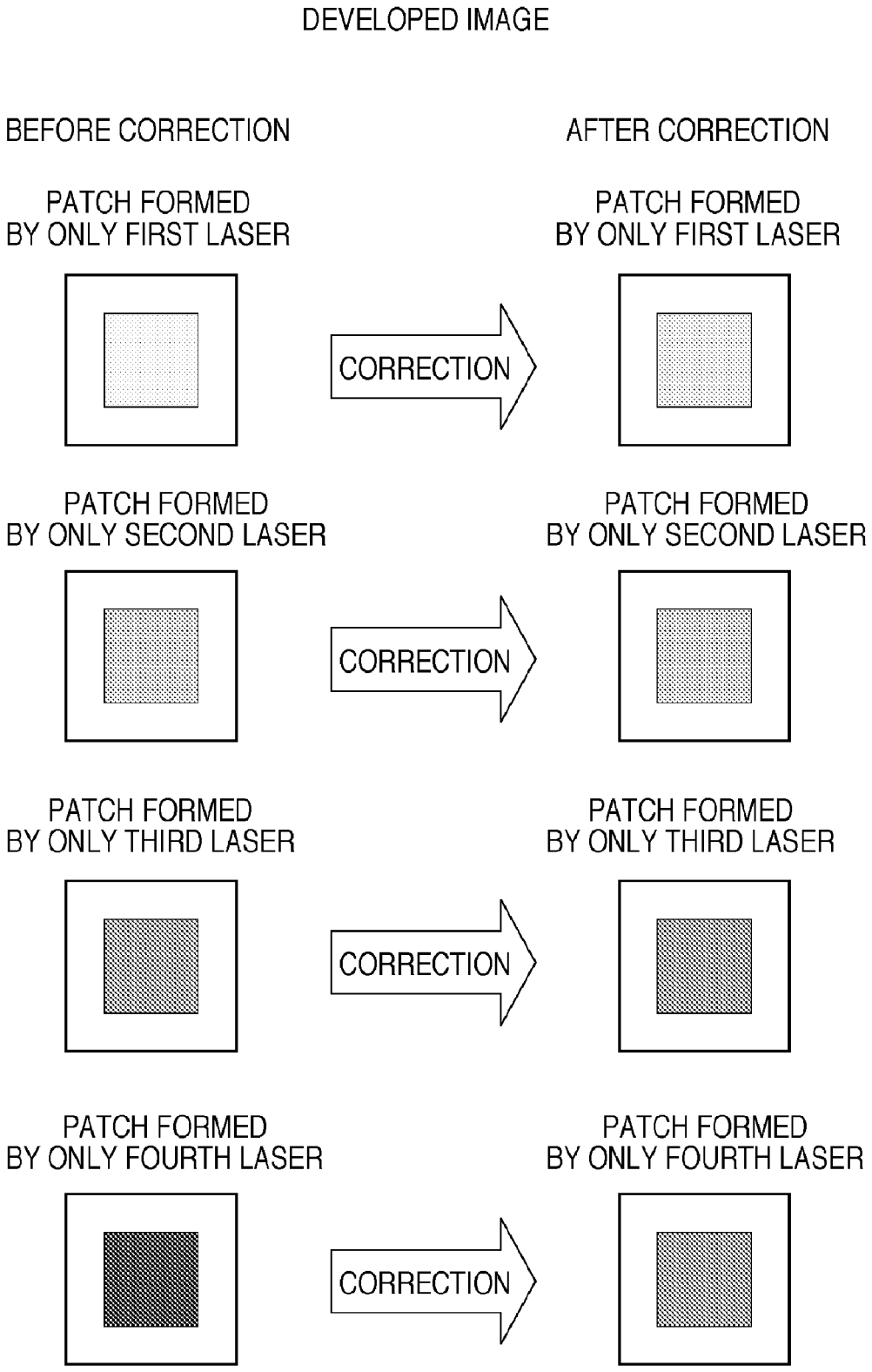
FIG. 5 is a view showing an example of a corrected developed image according to the first embodiment of the present invention.

FIG. 5 is a view showing a developed image before adjusting the laser intensity and a developed image after adjusting it according to the first embodiment of the present invention.

In this manner, the laser intensity of each laser in the multi-beam array is adjusted. As a result, the density after development hardly changes, suppressing density nonuniformity.

In the first embodiment, the density sensor 81 measures a patch image serving as a toner image primarily transferred on the intermediate transfer drum 51. However, the density of a patch image transferred on the transfer material S may also be measured.

The first embodiment has exemplified an arrangement in which the exposure unit 3 scans and exposes the photoconductive drum 1 simultaneously with four beams. However, the number of beams is not limited to this. The first embodiment is also applicable to N (N: an integer) beams with which the exposure unit 3 can scan and expose the photoconductive drum 1 simultaneously.

As described above, according to the first embodiment, the laser intensities of multiple beams are corrected to make the density of a formed image coincide with a target density. The first embodiment can suppress density nonuniformity of a developed image, improving the image quality.

Second Embodiment

Figure 6:
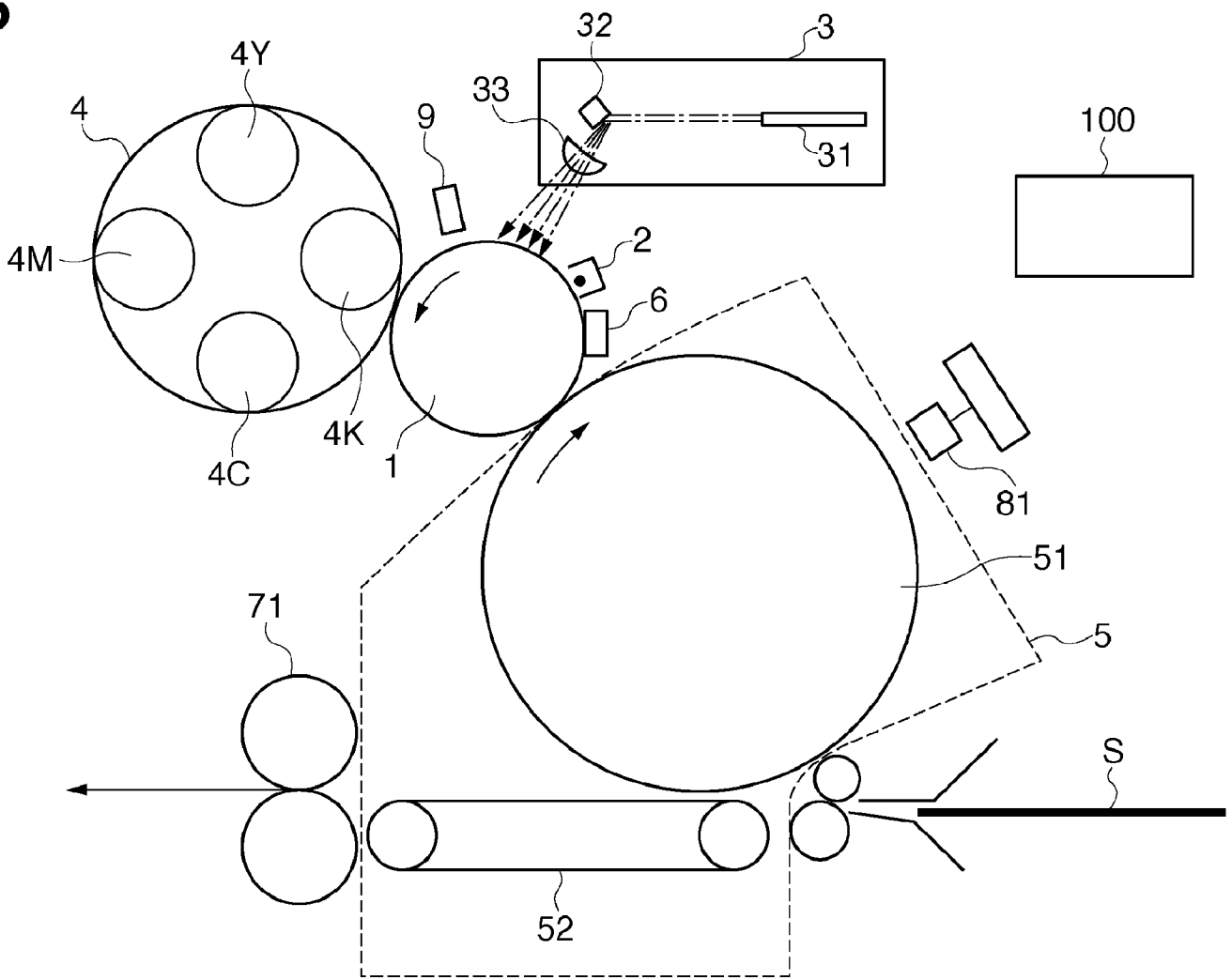
FIG. 6 is a sectional view showing the schematic structure of an image forming apparatus according to the second embodiment of the present invention.
Figure 7:
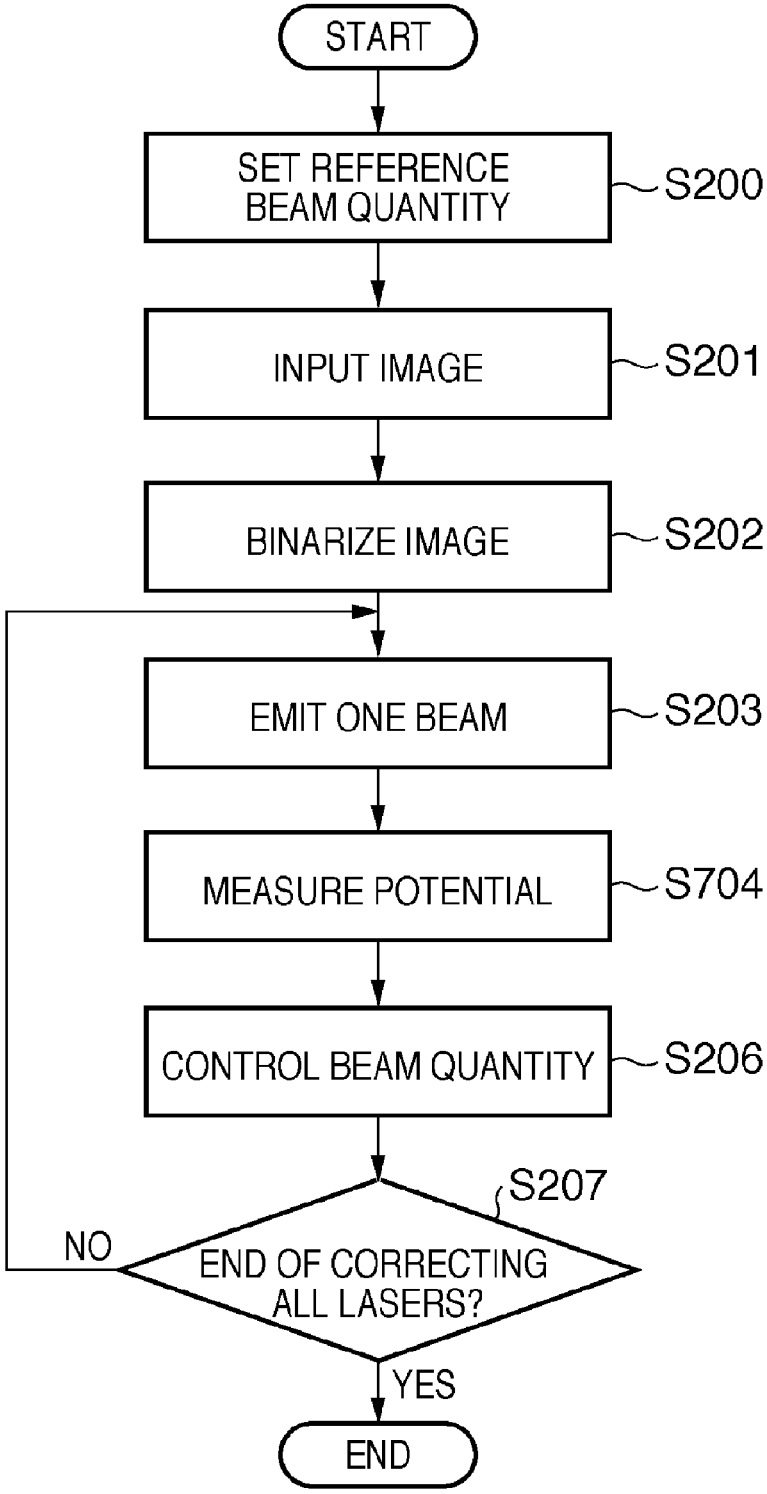
FIG. 7 is a flowchart showing the sequence of processing for controlling the quantities of multiple beams emitted from a laser oscillator according to the second embodiment of the present invention.

The second embodiment will be described with reference to FIGS. 6 and 7. The schematic structure of the whole apparatus according to the second embodiment shown in FIG. 6 is the same as that according to the first embodiment shown in FIG. 1. The same reference numerals as those in the first embodiment denote the same parts, and a description thereof will not be repeated.

FIG. 6 is a sectional view showing the schematic structure of an image forming apparatus according to the second embodiment of the present invention.

In FIG. 6, a potential sensor 9 is arranged downstream of an exposure unit 3 in the drum rotating direction between a charging unit 2 for forming an electrostatic latent image on the outer surface of a photoconductive drum 1 (on the image carrier) and a developing unit 4 for developing an electrostatic latent image into a visible image.

The charging unit 2 uniformly charges the surface of the photoconductive drum 1. When the exposure unit 3 exposes the surface of the photoconductive drum 1 in accordance with input image data, the surface potential distribution changes to form an electrostatic latent image. The potential sensor 9 measures the surface potential of the photoconductive drum 1. The potential sensor 9 detects, as a potential value, a potential change corresponding to an electrostatic latent image (step S704 in the flowchart of FIG. 7). The laser intensity is adjusted by comparing the surface potential value with a potential value corresponding to a preset density. More specifically, the laser intensity is adjusted by making the surface potential value of a patch image coincide with a predetermined potential value.

As described above, the second embodiment can obtain the same effects as those of the first embodiment by using the measurement result of the surface potential value of the photoconductive drum.

Third Embodiment

The schematic structure of the whole apparatus according to the third embodiment is the same as those according to the first and second embodiments, and a description thereof will not be repeated.

The first and second embodiments have exemplified an arrangement which forms an electrostatic latent image by emitting beams one by one from the respective lasers of the multi-beam array. However, the present invention is not limited to this. The third embodiment will explain a method of adjusting the laser intensity of each laser by using a plurality of lasers (at least two laser beams) in the multi-beam array.

In the third embodiment, the number of lasers in the multi-beam array is 1 (main scanning direction)×4 (sub-scanning direction) for descriptive convenience. However, the present invention is applicable to an image forming apparatus using an arbitrary number of lasers. Two lasers in the multi-beam array emit beams at once to adjust the laser intensity, but the present invention is not limited to this.

Figure 8:
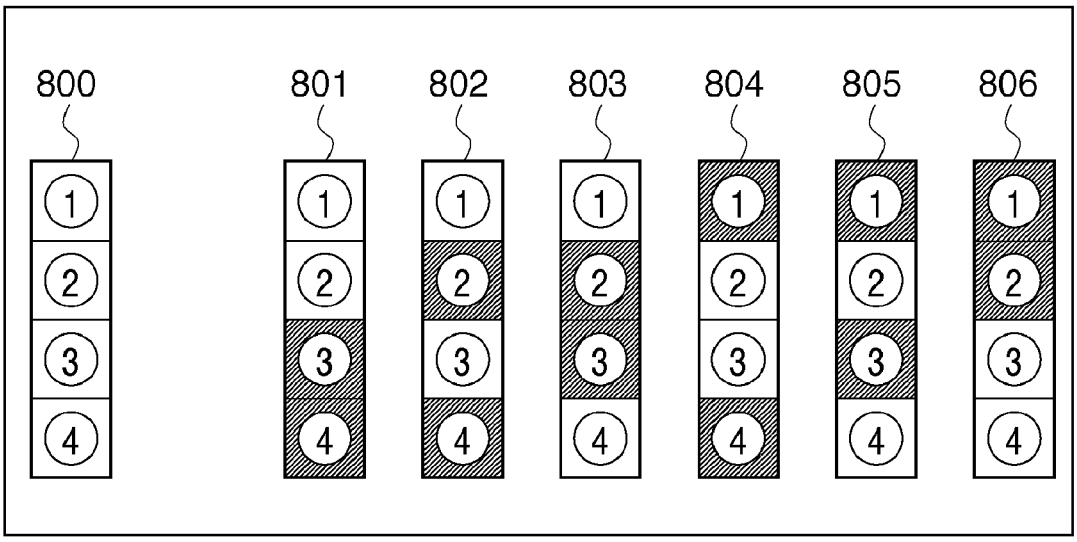
FIG. 8 is a view showing an example of a multi-beam array according to the third embodiment of the present invention.

In FIG. 8, each circle in a multi-beam array 800 represents a laser, and the figure in each circle is a laser number. Combinations 801 to 806 represent examples of a combination of the numbers of lasers used to emit beams from two lasers. For example, the combination 801 uses the first and second lasers.

To correct the laser intensity of the first laser to be adjusted, the surface of a photoconductive drum 1 is irradiated by lasers of the combinations 801, 802, and 803 which use the first laser, thereby forming electrostatic latent images. The average of the measurement results of the combinations 801, 802, and 803 is used as the measurement result of the first laser to adjust the laser intensity, similar to the first and second embodiments.

To correct the laser intensity of the second laser, the combinations 801, 804, and 805 which use the second laser suffice to be used.

Similarly, to correct the laser intensity of the third laser, the combinations 802, 804, and 806 suffice to be used. To correct the laser intensity of the fourth laser, the combinations 803, 805, and 806 suffice to be used.

As described above, according to the third embodiment, the laser intensity of each laser can be adjusted using the density of an image obtained by a plurality of lasers.

Note that the present invention can be applied to an apparatus comprising a single device or to system constituted by a plurality of devices.

Furthermore, the invention can be implemented by supplying a software program, which implements the functions of the foregoing embodiments, directly or indirectly to a system or apparatus, reading the supplied program code with a computer of the system or apparatus, and then executing the program code. In this case, so long as the system or apparatus has the functions of the program, the mode of implementation need not rely upon a program.

Accordingly, since the functions of the present invention are implemented by computer, the program code installed in the computer also implements the present invention. In other words, the claims of the present invention also cover a computer program for the purpose of implementing the functions of the present invention.

In this case, so long as the system or apparatus has the functions of the program, the program may be executed in any form, such as an object code, a program executed by an interpreter, or script data supplied to an operating system.

Example of storage media that can be used for supplying the program are a floppy disk, a hard disk, an optical disk, a magneto-optical disk, a CD-ROM, a CD-R, a CD-RW, a magnetic tape, a non-volatile type memory card, a ROM, and a DVD (DVD-ROM and a DVD-R).

As for the method of supplying the program, a client computer can be connected to a website on the Internet using a browser of the client computer, and the computer program of the present invention or an automatically-installable compressed file of the program can be downloaded to a recording medium such as a hard disk. Further, the program of the present invention can be supplied by dividing the program code constituting the program into a plurality of files and downloading the files from different websites. In other words, a WWW (World Wide Web) server that downloads, to multiple users, the program files that implement the functions of the present invention by computer is also covered by the claims of the present invention.

It is also possible to encrypt and store the program of the present invention on a storage medium such as a CD-ROM, distribute the storage medium to users, allow users who meet certain requirements to download decryption key information from a website via the Internet, and allow these users to decrypt the encrypted program by using the key information, whereby the program is installed in the user computer.

Besides the cases where the aforementioned functions according to the embodiments are implemented by executing the read program by computer, an operating system or the like running on the computer may perform all or a part of the actual processing so that the functions of the foregoing embodiments can be implemented by this processing.

Furthermore, after the program read from the storage medium is written to a function expansion board inserted into the computer or to a memory provided in a function expansion unit connected to the computer, a CPU or the like mounted on the function expansion board or function expansion unit performs all or a part of the actual processing so that the functions of the foregoing embodiments can be implemented by this processing.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-013087 filed on Jan. 23, 2008, which is hereby incorporated by reference herein in its entirety.

What is claimed is:

1. An image forming apparatus which has a light source for emitting a plurality of laser beams, forms a latent image on an image carrier with a plurality of laser beams emitted from the light source, and forms, onto a printing medium, an image developed on the image carrier, the apparatus comprising:

measurement unit adapted to measure image densities of solid images formed simultaneously with respective combinations of (a1) a laser beam to be adjusted and (a2) each of other laser beams; and adjusting unit adapted to adjust a quantity of each of the plurality of laser beams so that an average of the image densities of the solid images formed by the respective combinations of (a1) the laser beam to be adjusted and (a2) each of the other laser beams matches a target density in accordance with a measurement result of said measurement unit.

2. The apparatus according to claim 1, wherein said measurement unit measures, as the image density, a density of an output image formed on the image carrier or the printing medium on the basis of the image data.

3. The apparatus according to claim 1, wherein said measurement unit measures, as the image density, a potential value corresponding to a latent image formed on the image carrier on the basis of the image data.

4. The apparatus according to claim 1, wherein, by using image densities of images formed with respective laser beams that are measured by said measurement unit, said adjusting unit adjusts quantities of the corresponding laser beams.

5. A method of controlling an image forming apparatus which has a light source for emitting a plurality of laser beams, forms a latent image on an image carrier with a plurality of laser beams emitted from the light source, and forms, onto a printing medium, an image developed on the image carrier, the method comprising:

a measurement step of measuring image densities of solid images formed simultaneously with respective combinations of (a1) a laser beam to be adjusted and (a2) each of other laser beams; and an adjusting step of adjusting a quantity of each of the plurality of laser beams so that an average of the image densities of the solid images formed by the respective combinations of (a1) the laser beam to be adjusted and (a2) each of the other laser beams matches a target density in accordance with a measurement result of the measurement step.

6. A program stored in a non-transitory computer-readable medium to cause a computer to control an image forming apparatus which has a light source for emitting a plurality of laser beams, forms a latent image on an image carrier with a plurality of laser beams emitted from the light source, and forms, onto a printing medium, an image developed on the image carrier, the program causing the computer to execute a measurement step of measuring image densities of solid images formed simultaneously with respective combinations of (a1) a laser beam to be adjusted and (a2) each of other laser beams; and an adjusting step of adjusting a quantity of each of the plurality of laser beams so that an average of the image densities of the solid images formed by the respective combinations of (a1) the laser beam to be adjusted and (a2) each of the other laser beams matches a target density in accordance with a measurement result of the measurement step.

* * * * *